US006679179B1

(12) United States Patent
Bohl et al.

(10) Patent No.: US 6,679,179 B1
(45) Date of Patent: Jan. 20, 2004

(54) NON-LETHAL ELECTROMAGNETIC ACTIVE BODY

(75) Inventors: Jurgen Bohl, Eckenhaid (DE); Tilo Ehlen, Nuremberg (DE)

(73) Assignee: Diehl Munitionssysteme GmbH & Co., KG, Röthenbach (DE)

( * ) Notice: Subject to any disclaimer, the term of this patent is extended or adjusted under 35 U.S.C. 154(b) by 0 days.

(21) Appl. No.: 09/552,527

(22) Filed: Apr. 5, 2000

(30) Foreign Application Priority Data

Apr. 15, 1999 (DE) ..... 199 15 952

(51) Int. Cl.[7] ..... F42B 12/02

(52) U.S. Cl. ..... 102/501; 102/210; 89/1.11; 342/14; 455/98

(58) Field of Search ..... 102/207, 210, 102/501; 342/13, 14, 187; 455/98; 89/1.11

(56) References Cited

U.S. PATENT DOCUMENTS 3,589,294 A * 6/1971 Stresau ..... 102/210
3,756,157 A * 9/1973 England et al. ..... 102/210
3,922,968 A * 12/1975 Conger et al. ..... 102/210
4,090,448 A * 5/1978 Rose et al. ..... 102/210
4,751,429 A * 6/1988 Minich ..... 315/5
5,192,827 A 3/1993 Jasper, Jr. ..... 89/1.11
5,280,751 A * 1/1994 Muirhead et al. ..... 102/210
5,381,445 A * 1/1995 Hershey et al. ..... 102/501

FOREIGN PATENT DOCUMENTS

| | | |
|---|---|---|
| DE | 195 112 C1 | 12/1996 |
| EP | 0 757 224 A1 | 2/1997 |
| FR | 2 759 775 A1 | 8/1998 |
| JP | 2-279996 | 11/1990 |

* cited by examiner

*Primary Examiner*—Harold J. Tudor
(74) *Attorney, Agent, or Firm*—Scully, Scott, Murphy & Presser

(57) ABSTRACT

A non-lethal active body which is equipped with a detonation-operated electrical pulse generator, and which is especially deployable as an article of submunition. The pulse generator is a piezo-generator having a detonation-operated inductive current amplifier and a capacitive pulse shaper connected to the output thereof.

12 Claims, 2 Drawing Sheets

NON-LETHAL ELECTROMAGNETIC ACTIVE BODY

BACKGROUND OF THE INVENTION

1. Field of the Invention

The present invention relates to a non-lethal active body which is equipped with a detonation-operated electrical pulse generator, and which is especially deployable as an article of submunition.

2. Discussion of the Prior Art

An active body of that type is known as a microwave disrupter which is utilized for influencing the functioning of generally signal communications or guidance and control installations. The active body can be deployed as an article of submunition in accordance with the disclosure of European Patent Publication EP 075 572 24 A1, installed as a lurking mine pursuant to German Patent Publication DE 19 528 112 C1, or fired as a grenade in accordance with the disclosure of U.S. Pat. No. 5,192,827. With regard to the grenade constructed pursuant to the U.S. Pat. No. 5,192,827, prior to the firing, an internal electrical energy storage battery or accumulator is charged in the barrel or launch tube from an external current source, wherein the accumulator is then discharged upon reaching the object which is to be disrupted, by means of a spark gap, and thereby as a result generates high-frequencies disturbances. However, the power which is available for this purpose, in accordance with the behavior of the current source and the energy accumulator or battery, is extremely limited, and the loss or ohmic resistance of the capacitive charge accumulator, necessitates an excessively large capacitive time constant with regard to the sought after discharge time behavior over the spark gap.

In the two first mentioned instances a detonation-operated magneto-hydrodynamic system which is located on board of the active body serves as an electrical pulse generator, whereas within the framework of the present invention description where must be taken into consideration for the detonation operation, propellent charge materials, as well as explosives materials. For current amplification and exciting oscillations, that pulse generator has a similarly detonation-operated magnetic field compressor connected to the output thereof which compressor is to act radially on the center axis, and which irreversibly reduces the cross-sectional surface of a cylindrical coil which is just to be streamed through by the pulse current from the generator.

SUMMARY OF THE INVENTION

Accordingly, it is an object of the present invention to further develop an active body of the type under consideration for the utilization thereof as a projectile-like deployable, autonomous explosives-operated microwave source of reduced constructional size with a concurrent increase in degree of effectiveness in a direction towards selectable disruptive spectra, and in connection therewith to open up capabilities of constructive and circuitry technology modifications and further embodiments with a view towards different scenarios for application.

The foregoing object is inventively attained in that the pulse generator is a piezo-generator having a detonation-operated inductive current amplifier and a capacitive pulse shaper connected to the output thereof.

Further objects of the invention reside in that the combination of the pulse generator with different pulse shapers is adapted for different radiation spectra and the technological apparatus design apparatus for such combinations.

In accordance with the invention, in contrast with the utilization of a magneto-hydrodynamic generator pursuant to the state of technology, there is employed a more compactly constructed pulse generator which is excited under the effect of a detonation pressure wave with a comparatively large-volumed piezo-crystal for the emitting of a high current pulse, to the output of which there is similarly connected a detonation-operated inductive current amplifier ahead of a capacitive pulse shaper. In the pulse generator there can be implemented an axial pressure imposition from at least one massive (cubic or cylindrical) piezo-crystal, or a radial pressure imposition from at least one ring-shaped piezo-crystal. When a plurality of piezo-crystals are connected to each other, in order to produce a higher pulse output, then there are expediently introduced shock absorbers between the piezo-crystals which are connected either in parallel or series, in order to resiliently cushion the detonatively triggered mechanical pressure build-up during the transmission to the presently successive crystal bodies.

The pulse generator and the current amplifier are preferably assembled space-savingly coaxially behind each other, however, partially overlapping each other, in effect, axially interengaging, so as to be able to upon the triggering of the one functional element to be able to concurrently trigger through to the other, and to achieve a compact and resultingly lighter-weight deployable active body. The coaxial cable or respectively, hollow conductor for pulse shaping can be wound about the pulse generator, whose diameter is typically smaller than that of a current amplifier, and also smaller than that of the antenna, so that the antenna itself, in the interest of obtaining an axially short construction of this active body, at an expedient electrical degree of efficiency of its functional components, can be axially slid most closely against the pulse generator.

The effect of a herein preferred, similarly detonatively-operating inductive current amplifier is preferably predicated on an axial continually advancing opposite short-circuiting of adjacently located windings of a cylinder coil which is presently streamed through by the generator-current pulse. A capacitive pulse shaper which is connected in series with the pulse generator and coil, forms in conjunction with the coil, whose inductivity decreases rapidly, an electrical oscillating system with a rapidly rising resonance frequency, which is radiated as the carrier frequency band through the remaining coil windings which act as an antenna. Superimposed on this amplitude-modulated high-frequency carrier are the highest-frequencied disruptive components which are based on high voltage arc-overs, which are produced during the advancing coil short-circuit in the microwave frequency band.

For attaining a most possibly narrow-banded defined spectrum of the energy rich microwave radiation, the piezo operator instead of operating on the series resonance capacities operates more expediently on a pulse shaper in the form of a coaxial conductor designed in accordance with Bl ümlein for the supplying of a vircator, to the output of which there is connected, through a wave conductor, a horn antenna which is correlated with this comparatively narrow generated frequency band. When instead of the foregoing, there is given preference to a broader radiation spectrum, then there is supplied a spiral or snail-shaped antenna structure through a pulse shaper in the type of a coaxial pulse compression conduit, possibly through the conversion of generated unipolar pulses into shorter bipolar pulses.

In order not to excessively limit the radiatable microwave output through short-circuiting phenomena between the dipoles of a miniaturized antenna, the antenna structure operates expediently in an insulating gas space, which is preferably formed towards the end of the deployment phase of the active body through the extension and filling of a balloon, when the detonative conversion commences for activation of the pulse-generator and the current pulse-amplifier. For the presented and subsequently described components of explosive operated microwave generators, there is contemplated legal protection for the exemplary representation not only with regard to its opposite combination, but also the construction of the apparatus of the present circuitry components themselves are considered to be novel and patentable.

In every instance, there is inventively equipped a non-lethal electromagnetic body, which is deployable in a direct shot or firing or as an article of submunition, in the interest of a more compact construction at a high current capacity with a detonation operated piezo pulse generator, which preferably operates on a pulse modulator in the form of a similarly detonation operated inductive current amplifier having a coil with forward advancing short-circuiting in an axial direction. The latter is interconnected with at least one oscillating capacitance, when operated not for a defined microwave radiation spectrum from the pulse generator, but upon occasion through the current amplifier, such as a horn irradiator through a Blümlein pulse shaper and a vircator. For the supplying of a broad-banded radiating antenna, for pulse compression there can instead thereof be provided a coaxial cable, preferably with a bypass cable for bipolar pulse modulation, whose output signals which are recalled through a lengthy spark gap are shortened by means of a transverse spark gap. In order to be able to radiate a higher microwave output, the antenna is expediently operated below a balloon-like expandable radome in an insulating gas volume.

BRIEF DESCRIPTION OF THE DRAWINGS

Further features and advantages as well as additional modifications and embodiments of the invention can be ascertained from the following detailed description, having reference to the drawings, which are limited to the essentially implemented embodiments which are not illustrated to scale, and employed for attaining the inventive objects; in which.

DETAILED DESCRIPTION OF PREFERRED EMBODIMENT

Figure 1:
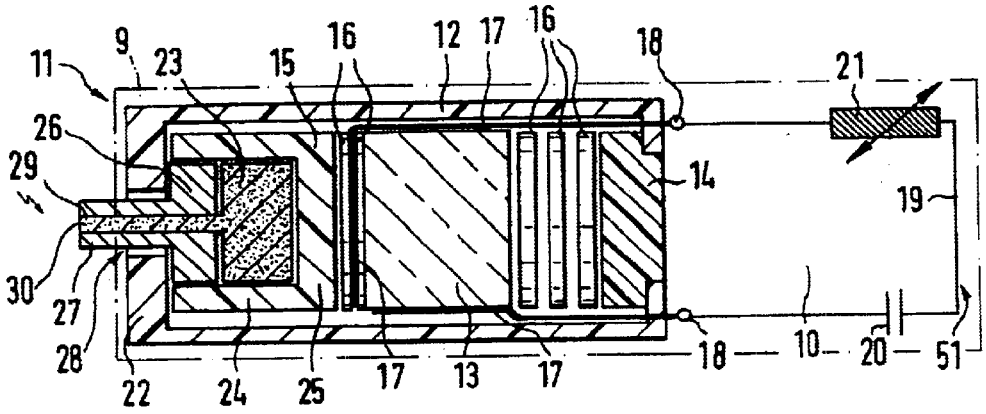
FIG. 1 illustrates a detonation-operated electrical pulse generator, shown here with an axially acted upon large-volumed piezo-crystal as a charging source.

For the non-lethal electromagnetic active body 9 which is illustrated in FIG. 1 in an axial longitudinal cross-section, a current amplifying pulse transformer modulator 10 is supplied by a detonation-operated piezo-pulse generator 11. The latter, in the instance of the represented axial excitation provides within an encasing tube or shell 12, a square or short cylindrical piezo-crystal 13 located between a supporting mass 14 and an activating mass 15. Arranged between the piezo crystal 13 and the masses 14 and 15 which support the former on both sides thereof, in this axial design there are provided disc-shaped shock absorbers 16, preferably consisting of a material, such as acrylic glass, in order to prevent a mechanical destruction of the piezo-crystal 13 at already the build-up of the steep mechanical voltage peak at the beginning of the compression of the piezo crystal. By means of electrodes 17 which contact against the sides of the piezo-crystal 13, there is tapped off the charge displacement which occurs transversely of the axially through-running shockwave as the generator voltage, for the conducting off of this pulse-shaping charging shift through the loaded generator-output terminals or clamps 18. Connected to these are the time-variably inductivities 21 as the pulse modulator 10, as current amplifier 31 and capacitances 20 as pulse shaper 51, such as is clarified in a simple representation in the example of FIG. 1 by a block circuit diagram of a series resonance-discharging circuit 19.

For a strong pressure acting on the piezo crystal 13 under the step slope of the pressure rise over time, there is arranged a pyrotechnic detonator 23 between a bottom 22 of the encasing tube or shell to 12 and the activating mass 15, preferably under a damming towards the side by means of the surrounding wall 24 of a pot-shape configured activating mass 15 which is open facing towards the shell bottom 22. Opposite the pot-shaped bottom 25 and thereby also opposite the supporting mass 14, there is retained behind the detonator 23, in the shell bottom 22, a ram or mushroom-shape configured countermass 26, the shank 27 of which protrudes coaxially through a central opening 28 in the shell bottom 22, and which itself, in a central through-extending passageway 29 thereof, is filled with explosives material 30, which for the triggering of the detonator 23, is in physical communication with the latter.

When the detonator 23 is triggered throughout, through the explosives material-passageway 29, the countermass 26 is subjected to an axial pressure loading or force acting opposite the axially movably supported activating mass 15, in a direction towards the crystal 13, whereby it transmits as a through-advancing detonation pressure wave to the piezo-crystal 13, as a result of which, the latter, still prior to its mechanical destruction, by means of the output terminals or clamps 18 generates a voltage signal of a few tens of kilovolts in intensity, which produces a correspondingly strong current pulse to pass through the discharging circuit 19, so that its L-C circuit is high-frequencied amplitude-modulated and caused to oscillate in the shape of an attenuating curve.

Figure 2:
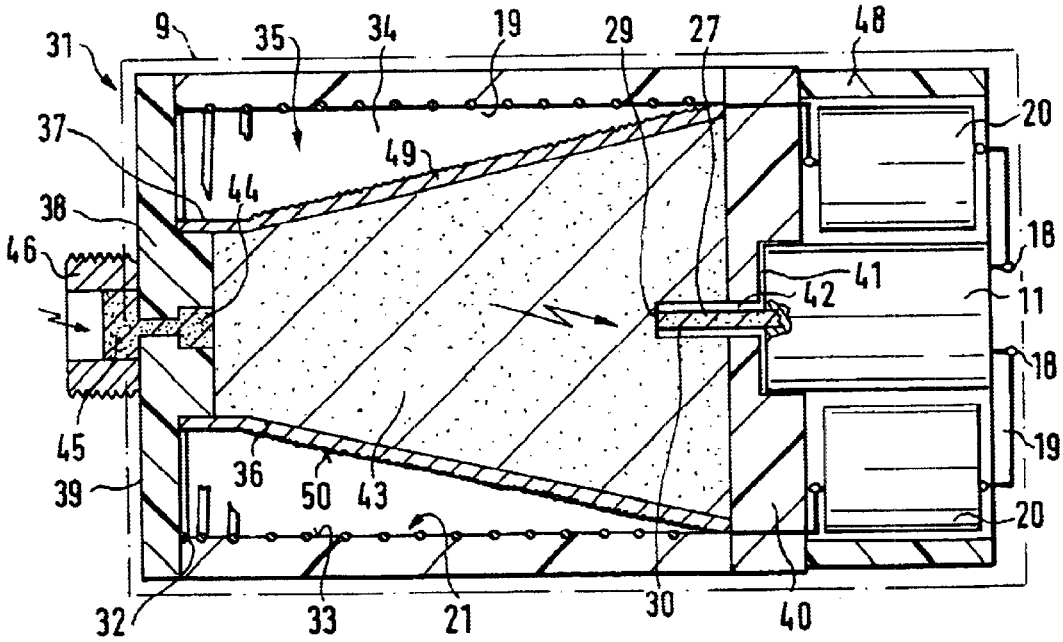
FIG. 2 illustrates a similarly detonation-operated inductive current amplifier with a piezo-generator according to FIG. 1, attached at the end surface, to which there is connected a capacitive pulse shaper, which is based on a series resonance.

In accordance with FIG. 2, the generator 11 is structurally united with a current amplifier 31, which is based on the operative principle of an inductivity 21 which is quasi-continually but extremely rapidly and progressively reduced under a current flow. As the inductivity 21 there is herein provided a coil 32 whose axially mutually spacedly extending windings are arranged insulated on the internal casing surface 33 of a hollow-cylindrical housing 34.

Retained coaxially in the interior of the housing 34 is a hollow truncated cone 36, of which its smaller end surface forms a transition into a hollow cylinder 37, which is seated in a close fit on a base part 38 of a housing bottom 39. Oppositely,the hollow truncated cone 36 ends with its largest cross-sectional surface in the region of the inner casing surface 33, in front of a massive housing cover 40. For the coaxial receipt of the piezo generator 11, the housing cover 40 is equipped with a central depression 41, whereby the triggering passageway 29 for the activation of the generator 11 projects through a hole 42 in the cover 40, and terminates openly in the interior of the hollow truncated cone 36 which is filled with explosives 43. Opposite the triggering passageway 29 there similarly introduced a detonator 44 in the bottom base 38 of the housing 34 which is designed as a massive contermass, which is in pyrotechnic operative connection with a primer capsule 45 in the interior of a hollow threaded pipe 46. A sleeve which encompasses the housing cover 40 as an extension of the housing wall 47, acts as a radial bordering for a number of capacitances 20 which are connected in series with the coil 32, whose constructive arrangement encompasses the centrally positioned generator 11 in a ring-shaped arrangement. The generator-discharge circuit 19 extends thus between the output terminals or clamps 18 through the capacitances 20 and the coil 32 of a reducing inductivity 21 which is located radially outside of the hollow truncated cone 36.

The triggering of the explosive material 43 by means of the detonator 44 leads practically simultaneously to the continued triggering in the passageway 29, and thus to the pulse activation of the piezo-generator 11. The thereby initiated voltage pulse causes a pulse-shaped but amplitude-modulated high-frequency oscillating current flow through the discharge circuit 19; in effect, through the series circuit consisting of capacitances 20 and inductivity 21. This pulse-like initiated oscillation amplitude is then extremely intensified by the current amplifier 31, inasmuch as the inductivity 21 is rapidly decreased by an axially oriented, progressively advancing short-circuiting of the coil 32. This short-circuiting is effected through the casing 29 of the hollow truncated cone 36, which is constituted of ductile metal, such as copper or aluminum, whereby through the radial components of the detonation wave from the triggered explosive material 43 which is propagated from the small to the large base along the cone generatrix, is ripped open and flap-shaped bent radially outwardly, until it comes to an electrical winding short-circuiting on the coil 32 as a result of the contact of the casing 49 against the housing in casing surface 33. This process propagates thus forwardly extremely rapidly from the triggering region at a small conical cross-section in an axial direction towards the large cross-section, so that increasingly more neighboring coil windings are short-circuited with mechanical damaging of their insulation. The thereby encountered reduction in the inductivity 21 is progressive in accordance with the measure of the conicity of the truncated cone 36 and the detonative conversion behavior of the explosive material 43 with an increasing cross-sectional volume, as well as also pursuant to an increasingly reduced axial spacing between the adjacently located windings of the coil 32.

The thereby forcible steep rise in the amplitude of the oscillating current pulse, due to the rapid reduction of the inductivity 21, is in synch with a steep frequency rise of the current oscillation, which through the remaining windings of the coil 32 acting as an antenna, leads; in effect, to an intensive energy-rich high-frequency radiation with a relatively broad amplitude-modulated frequency mixture in the megahertz range. Superimposed on this frequency mixture with regard to its active mechanism are additional interesting highest frequency oscillations in the microwave spectrum (gigahertz range), which have different causes. Thus, the nitrogen molecules in the explosive filling 43 of the hollow truncated cone 36, due to the pressure and temperature effects of the detonatively converted explosive material 43, are imparted an increase to an elevated energy level, from which they are forced back by the magnetic field of the coil 32 and thereby irradiate the highest-frequencied energy. Furthermore, through arcing or flashings-over in the radial high voltage field between the coil 32 and the hollow truncated cone 36, there are produced sparks directly ahead of their mutual contacts. The microwave radiation is still further intensified through a propagation of forward advancing steep spark flashovers; for example, due to a roughened or stripped surface 50 of the truncated cone casing 49 which is located opposite the windings of the coil 32. When the ring-shaped hollow space between the cylindrical inner casing surface 33 and the truncated cone casing 49 is filled with an electrically-excitable gas such as argon, then this leads to flash-over avalanche effects, and thereby to a further rise in the efficiency of the microwave radiation.

Thus, the combination sketched in a longitudinal cross-sectional view in FIG. 2, presents a detonation-operated piezo-pulse generator 11 with a similarly detonation-operated current amplifier 31, a compact and shock resistance, in effect, a firing-secured assembly for an active body 9 which is deployable as a type of barrel-fired ammunition, as an efficient local autonomous microwave-disruptive transmitter, which derives its primary current from the high energy density of an explosion subjected piezo-crystal 13. When this electrically active body 9 descends, while being braked by a parachute, into a target area, then the effect of the microwave radiation in the target area can be still further intensified by bundling or collimating, in that the parachute itself is generally designed to face downwardly so as to act as a reflector.

Figure 3:
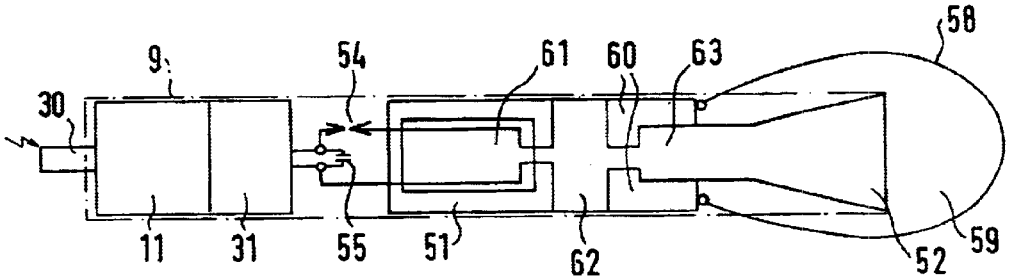
FIG. 3 illustrates a piezo generator, such as according to FIG. 1, as a current source for a pulse shaper with a correlated microwave antenna.
Figure 4:
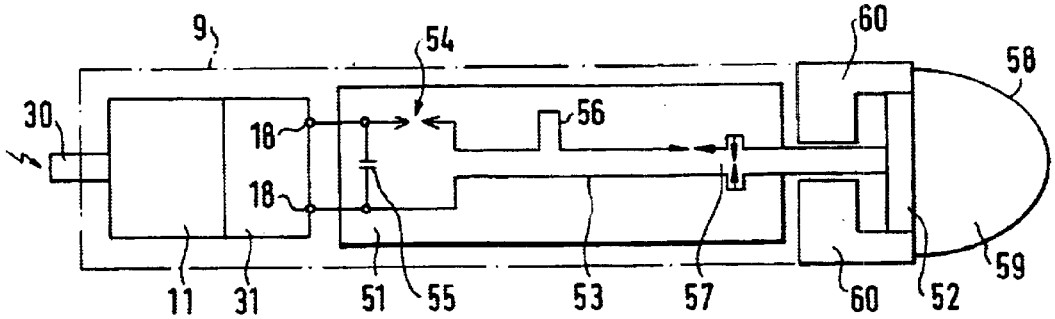
FIG. 4 illustrates a piezo generator, such as according to FIG. 1, as a current source for a pulse shaper with a broad-banded radiating microwave antenna.

For an increase in output with regard to the radiated microwave energy, instead of a mere radiation through the remaining windings of a current amplifier coil 32 in accordance with FIG. 2, the piezo generator 11, according to FIG. 1, can also be switched in accordance with FIG. 3, and as in accordance with FIG. 4, by means of pulse shaper 51 to a therewith correlated antenna 52.

A significantly higher frequency for the microwave radiation is achieved, when for this purpose the detonation-activated piezo-generator 11 has not, as in FIG. 2, the output thereof connected with a simple, time-variant series-resonance circuit, but when the generator 11, possibly again through a similarly explosives-operated current amplifier 31, such as pursuant to FIG. 2 (however, then without any oscillatory capacitances) or, in accordance with other constructional or operative principles, operates on a pulse shaper 51, ahead of a therewith optimized antenna 52 with directed radiation. The supplying of a unipolar or microsecond pulse into the pulse shaper 51 is effected in accordance with FIG. 3 through a high-voltage switch 54 in the form of a flash-over or sparking section from a storage capacitor 55, as soon as, in turn, it is charged from the piezo generator 11 (possibly through a current amplifier 31), to a sufficiently high voltage. A so-called Blümlein pulse shaper 61, a coaxial discharge conductor with a voltage increase at a short high-voltage pulse in the magnitude of 100 kv at the input, shortens under a rise in the steepness of the input pulse slope to approximately 10% of its original length, so as to thereby excite a vircator 62, in effect, a magnetic field-free operating microwave diode in the gigahertz range, as a further pulse compressor, which then emits a short pulse packet with the highest-frequency bipolar carrier oscillation through a wave conductor 63 to the antenna 52. This, in the interest of a good degree of effectiveness, is preferably designed as a horn irradiator, and correlated to the middle carrier frequency of such pulse packet.

When, however, less than a possibly highest radiation yield is much more of interest, especially a pulse-shaped broad-banded microwave radiation, inasmuch as this can then no longer be blended out, as a hardening measure for the point-of-gravity effective discrete disruptive frequency of the mono-frequencied directed radiation through the horn irradiator 52 pursuant to FIG. 3, the detonative piezo-pulse generator 11, possibly again through a similarly explosives-operated current amplifier, then operates expediently on a pulse shaper 51 with a broad-banded antenna 52 pursuant to FIG. 4 being connected to the output thereof. The pulse shaper 51 consists herein essentially of a comparatively lengthy coaxial cable 53, which in contrast with the simplified principle representation of FIG. 4, is not lineally extended for the apparative implementation of a firing-secured active body 9, but is wound around the generator 11. The supplying with a pulse into the coaxial cable 53 which is shortened in contrast with that of the piezo current generator 11, is again effected through a high voltage switch 54 in the form of a flash-over or sparking section from a storage capacitor 55 as soon as the latter is charged up from the generator 11 to the flashover potential. A running time-tie cable 56, due to the phase-rotating short-circuiting at its ends, causes the conversion of the unipolar discharge pulse from the storage capacitor 55 into two mutually distanced, still shorter pulses of opposite polarity and thereby suppression of the originally contained and non-radiatable direct-current energy component. Between the end of the coaxial cable 53 and the supplying into the antenna 52, there is still expediently provided a switch combination 57 of a longitudinal flashover section for responding and a transverse flashover section for the short-circuiting of every incoming pulse forth further pulse compression through the cutting of, respectively, a shorter and steeply sloping part. Thus, the antenna 52 of the explosives-operated microwave pulse irradiator, due to this pulse compression is no longer controlled with the unipolar microsecond pulse from the discharge of the storage capacitor 55, but with a bipolar pair of extremely steeply sloping nanosecond pulses and thereby a correspondingly broad-banded in the gigahertz range.

Especially the geometric structure of the broad banded highest-frequencied antenna 52 requires a minimal spacing between the antenna dipoles and thereby an increased danger of flashing-over, and as a result of the thus occurring restriction of the control voltage, a limitation of the radiatable highest-frequency output. In order to render the antenna 52 secure against any sparking or flashing-over, its active radiation surface (possibly also if required, also the radiation dipole of a horn antenna 52 according to FIG. 3) lies behind a radome 58 in an insulating gas volume 59, such as is commercially available as "SF-6", high-voltage, high-frequency insulating gas, which bonds free electrons in order to prevent an avalanche effect. For a deployable microwave disruptive system there is contemplated that the radome 58 is constructed on the active body 9 as a flexible balloon, which during the charging and deployment phases is folded into a storage spaces 60 behind the antenna 52. Parallel to the pyrotechnic activation of the generator 11, and possibly that of the additionally provided current amplifier 31, there can be initiated a pyrotechnically-initiated blowing out of the casing of the radome 58 under the filling out of the inner space with insulating gas from a pressurized supply container.

What is claimed is:

1. A non-lethal electromagnetic active body (9) constituting an article of munition, said active body being microwave disruptive so as to produce disruptive microwaves, including a detonation-operated electrical pulse generator (11), said generator comprising a piezo generator (11); a detonation-operated inductive current amplifier (31) connected to said piezo generator (11); a capacitive pulse shaper (51) being connected to an output of said current amplifier (31), said pulse shaper (51) includes a coaxial cable (53) including a pair of longitudinally and traversely connected high-voltage switches (57), said pulse shaper supplies a broad-band radiating antenna (52); said coaxial cable (53) being equipped with a running time-tie cable (56) for the transforming of a unipolar pulse into a shortened pair of bipolar pulses.

2. The active body according to claim 1, wherein said coaxial cable (53) is supplied with pulses from a storage capacitor (55) through a high-voltage switch (54).

3. The active body according to claim 1, wherein said antenna (52) has the electrically-supplied structure thereof arranged within an insulating gas volume (59).

4. The active body according to claim 3, wherein said insulating gas volume (59) is formed within a radome (58) which is constructed as a balloon extractable from a storage space (60) proximate the antenna 52.

5. The active body according to claim 1, wherein said piezo generator (11) includes a tubular shell (12), and at least one piezo-crystal (13) being arranged in said shell between a supporting mass (14), a detonator (23) and shock absorbers (16).

6. The active body according to claim 5, wherein the detonator (23) is arranged in an activating pot-shaped mass (15) in front of a bottom (22) of the shell (12), said mass (15) being closed facing toward the piezo-crystal (13), and said detonator (23) is triggerable through a passageway (29) penetrating through the bottom 22.

7. The active body according to claim 1, wherein said current amplifier (31) possesses an inductivity (21) which reduces during supplying current from said piezo-generator (11).

8. The active body according to claim 7, wherein said current amplifier (31) possesses a hollow truncated cone (36) within a coil (32), said cone (36) being filled with detonation material (43) in the region of a smaller cross-sectional base surface of said cone.

9. The active body according to claim 8, wherein said piezo-generator (11) is retained in the region of the largest cross-section of the hollow truncated cone (36) and is equipped with a triggering passageway (29) which is open facing towards the interior of the hollow truncated cone (36).

10. The active body according to claim 8, wherein radially oppositely located regions of the coil (32) and of the hollow-truncated cone (36) are designed as parasitic flash-over sections.

11. The active body according to claim 8, wherein a plurality of capacitances (20) having variable inductivities (21) are connected to said coil (32) and are arranged about the periphery of the piezo-generator (11).

12. The active body according to claim 1, wherein said body comprises a deployable article of submunition.

* * * * *